US011507014B2

(12) United States Patent
Takai

(10) Patent No.: US 11,507,014 B2
(45) Date of Patent: Nov. 22, 2022

(54) DEVELOPMENT DEVICE AND IMAGE FORMING APPARATUS

(71) Applicant: KYOCERA Document Solutions Inc., Osaka (JP)

(72) Inventor: Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/489,110

(22) Filed: Sep. 29, 2021

(65) Prior Publication Data

US 2022/0100144 A1 Mar. 31, 2022

(30) Foreign Application Priority Data

Sep. 30, 2020 (JP) ..... JP2020-165053

(51) Int. Cl.
*G03G 21/16* (2006.01)
*G03G 15/08* (2006.01)

(52) U.S. Cl.
CPC ..... *G03G 21/1647* (2013.01); *G03G 15/0886* (2013.01); *G03G 21/1652* (2013.01); *G03G 21/1676* (2013.01)

(58) Field of Classification Search
CPC ..... G03G 15/0886; G03G 21/1647; G03G 21/1652; G03G 21/1676; G03G 2221/163
See application file for complete search history.

(56) References Cited

U.S. PATENT DOCUMENTS

2014/0153953 A1* 6/2014 Fujii ..... G03G 21/1652 399/90
2017/0269543 A1* 9/2017 Itabashi ..... G03G 21/1652
2017/0277119 A1* 9/2017 Sakai ..... G03G 21/1652
2021/0116853 A1* 4/2021 Kimura ..... G03G 21/1676

FOREIGN PATENT DOCUMENTS

JP H09-329964 A 12/1997

* cited by examiner

*Primary Examiner* — Sophia S Chen
(74) *Attorney, Agent, or Firm* — Studebaker & Brackett PC

(57) ABSTRACT

A development device is attachable to and detachable from an apparatus main body in an inserting/drawing direction. The development device includes a holder portion, a hook, a lever portion, and an elastic arm portion. The holder portion supports a board connectable to a controller of the apparatus main body. The hook is engageable with a recess of the apparatus main body. The lever portion is provided with the hook. At least one elastic arm portion connects the holder portion and the lever portion. In a middle of an attachment to the apparatus main body, the hook interferes with the apparatus main body to shift the lever portion in a direction crossing the inserting/drawing direction and to elastically deform the elastic arm portion. When the hook is engaged with the recess, the elastic deformation of the elastic arm portion is released and the board is connected to the controller.

7 Claims, 7 Drawing Sheets

DEVELOPMENT DEVICE AND IMAGE FORMING APPARATUS

INCORPORATION BY REFERENCE

This application is based on and claims the benefit of priority from Japanese patent application No. 2020-165053 filed on Sep. 30, 2020, which is incorporated by reference in its entirety.

BACKGROUND

The present disclosure relates to a development device attachable to and detachable from an apparatus main body and an image forming apparatus including the development device.

In the image forming apparatus, in many cases, the development device is attached to or detached from the apparatus main body along a predetermined inserting/drawing direction. Such a development device is provided with a lever member which is held by an operator when the development device is attached to or detached from the apparatus main body. For example, the handle (the lever) of the development tank (the development device) may be connected to a locking means for restricting the drawing of the development tank, and the locking means may be released by lifting the handle.

Further, the lever member may be provided with a hook portion which is engaged with a recess of the apparatus main body to restrict the drawing of the development device. In this case, in the process of attachment of the development device to the apparatus main body, the hook portion interferes with the apparatus main body to shift the lever member in a direction crossing to the attachment direction, and when the hook portion reaches the recess, the lever member is biased by a spring member to engage the hook portion with the recess. By shifting the lever member in a direction opposite to the above shift direction, the engagement between the hook portion and the recess is released, and it becomes possible to draw the development device out from the apparatus main body.

However, since the above-described lock means is configured to release an engagement between a lock claw and a projecting piece of the apparatus main body by turning a lock lever interlocking with the handle, there is a problem that the number of members and the number of assembling steps are increased. Further, even in a case where the hook portion is provided in the lever member, since the lever member needs to be supported via the spring member, there is a problem that the number of members and the number of assembling steps are increased.

SUMMARY

In accordance with an aspect of the present disclosure, a development device is attachable to and detachable from an apparatus main body in a predetermined inserting/drawing direction. The development device includes a holder portion, a hook, a lever portion, and at least one elastic arm portion. The holder portion supports a board connectable to a controller of the apparatus main body. The hook is engageable with a recess of the apparatus main body. The lever portion is provided with the hook. At least one elastic arm portion connects the holder portion and the lever portion. In a middle of an attachment to the apparatus main body, the hook interferes with the apparatus main body to shift the lever portion in a direction crossing the inserting/drawing direction and to elastically deform the elastic arm portion. When the hook is engaged with the recess, the elastic deformation of the elastic arm portion is released and the board is connected to the controller.

In accordance with an aspect of the present disclosure, an image forming apparatus includes an image forming part which forms a toner image on the sheet by the development device 1.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference the attached drawings, an image forming apparatus and a development device according to one embodiment of the present disclosure will be described.

Figure 1:
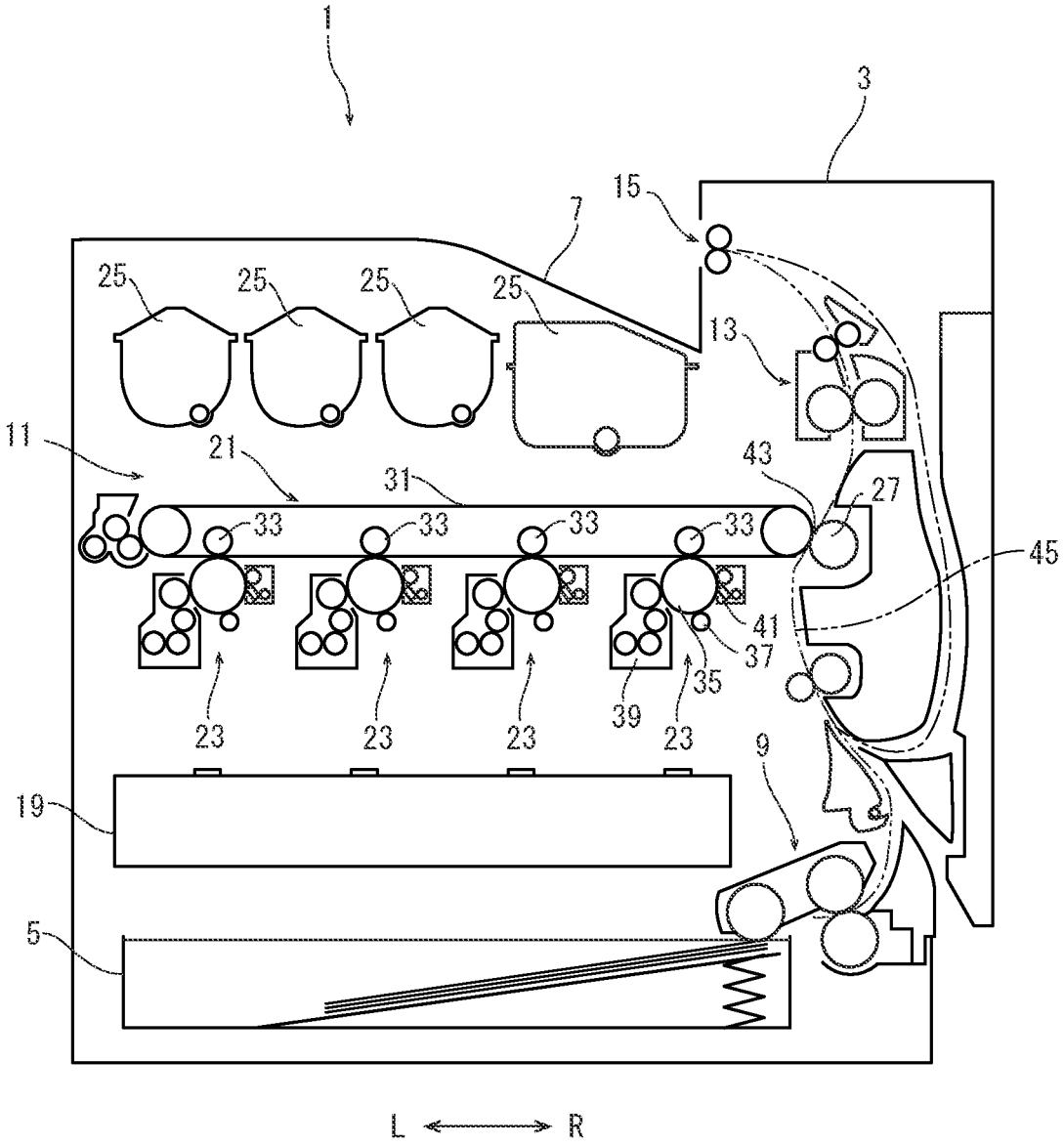
FIG. 1 is a sectional view schematically showing an inner structure of an image forming apparatus according to one embodiment of the present disclosure.

First, with reference to FIG. 1, the image forming apparatus 1 will be described. FIG. 1 is a front view schematically showing an inner structure of the image forming apparatus 1. In the following description, Fr, Rr, L and R marked in each drawing indicate a front side, a rear side, a left side and a right side of the image forming apparatus 1.

The image forming apparatus 1 includes an apparatus main body 3 having a substantially rectangular parallelepiped inner space. In the lower portion of the apparatus main body 3, a sheet feeding cassette 5 is stored. The sheet feeding cassette 5 is attachable to and detachable from the apparatus main body 3 along the front-and-rear direction. On the upper surface of the apparatus main body 3, a discharge tray 7 is formed.

In the inner space of the apparatus main body 3, a sheet feeding part 9 disposed above the sheet feeding cassette 5, an image forming part 11 disposed above the sheet feeding part 9, a fixing part 13 disposed above the image forming part 11, and a discharge part 15 disposed above the fixing part 13 are provided. The image forming part 11 includes an exposure device 19, an intermediate transfer unit 21, four image forming units 23, four toner containers 25, and a secondary transfer roller 27.

The intermediate transfer unit 21 includes an endless intermediate transfer belt 31 and four primary transfer rollers 33 disposed in the hollow space of the intermediate transfer belt 31. The intermediate transfer belt 31 is stretched between a driving roller and a driven roller disposed at an interval in the left-and-right direction, and travels in a predetermined direction. The four primary transfer rollers 33 are disposed along the traveling direction of the intermediate transfer belt 31 so as to face the lower side traveling area of the intermediate transfer belt 31.

Each image forming unit 23 includes a photosensitive drum 35 rotating in a predetermined rotating direction, a charging device 37, a development device 39, and a cleaning device 41 which are disposed around the photosensitive drum 35 in the rotating direction of the photosensitive drum 35. The four image forming units 23 are disposed along the traveling direction of the intermediate transfer belt 31 so as to face the lower side traveling area of the intermediate transfer belt 31 from the lower side. The photosensitive drum 35 of each image forming unit 23 faces the primary transfer roller 33 via the intermediate transfer belt 31 between the development device 39 and the cleaning device 41. The four toner containers 25 contain developer (toner) of four colors (yellow, magenta, cyan and black) and are connected to the development devices 39 of the respective image forming units 23.

The secondary transfer roller 27 is disposed so as to face the intermediate transfer belt 31, and a transfer nip area 43 is formed between the intermediate transfer belt 31 and the secondary transfer roller 27. Further, in the inner space of the apparatus main body 3, a sheet conveyance path 45 along which the sheet is conveyed from the sheet feeding part 9 to the discharge part 15 through the transfer nip area 43 and the fixing part 13 is formed.

An image forming operation will be described. When an image forming instruction is received, the photosensitive drum 35 of each image forming unit 23 of the image forming part 11 is charged by the charging device 37. The exposure device 19 irradiates the charged photosensitive drum 35 with a laser beam to form an electrostatic latent image on the photosensitive drum 35. The electrostatic latent image is developed into a toner image by the development device 39 with the toner supplied from the toner container 25. The toner image is transferred from the photosensitive drum 35 to the intermediate transfer belt 31 by the primary transfer roller 33. By the four image forming units 23, the toner images of the four colors are superposed on the intermediate transfer belt 31 to form a full-color toner image. On the other hand, the sheet is fed from the sheet feeding cassette 5 by the sheet feeding part 9, and is conveyed along the conveyance path 45 to the transfer nip area 43. The toner image is transferred from the intermediate transfer belt 31 to the sheet at the transfer nip area 43, and fixed to the sheet in the fixing part 13. The sheet is discharged by the discharge part 15 and stacked on the discharge tray 7.

Figure 2:
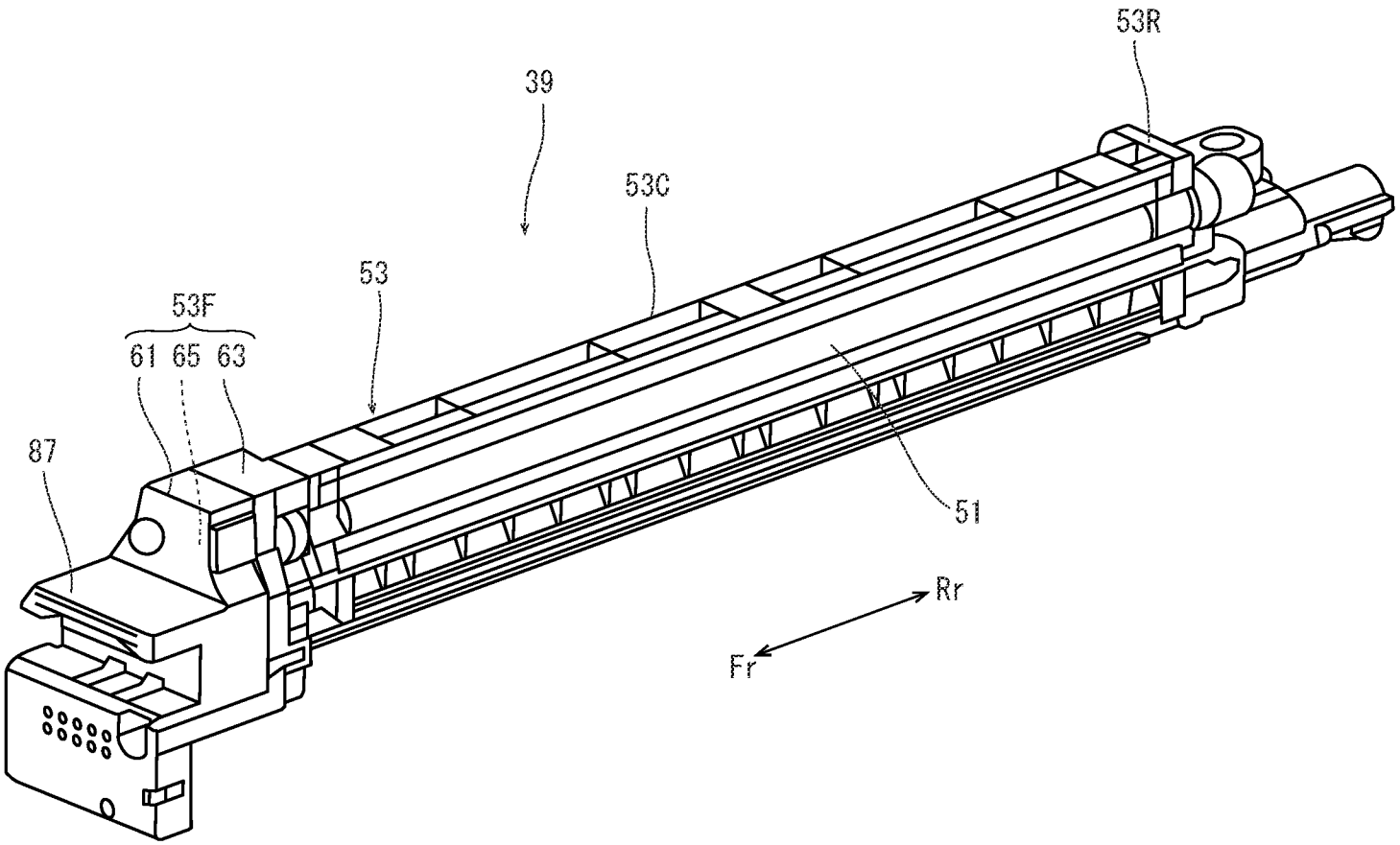
FIG. 2 is a perspective view showing a development device according to the embodiment of the present disclosure.

Next, with reference to FIG. 2, the development device 39 will be described. FIG. 2 is a perspective view showing the development device 39.

The development device 39 includes a magnet roller 51, an agitating roller, a supply roller (both rollers are not shown), and a housing 53 in which they are stored. The development device 39 is attachable to and detachable from the apparatus main body 3 in an inserting/drawing direction (the front-and-rear direction).

The housing 53 has a long shape in the inserting/drawing direction, and has a rear end part 53R on the downstream side (the rear side) in the inserting direction, a front end part 53F on the upstream side (the front side) in the inserting direction, and an enclosure part 53C between both the end parts 53R and 53F.

The rear end part 53R supports the rear end portions of the rotating shafts of the magnet roller 51, the agitating roller and the supply roller in a rotatable manner. Further, the rear end part 53R is provided with a roller driving part connected to a driving source provided in the apparatus main body 3, a toner replenishment part to which the toner is replenished from the corresponding toner container 25, and a waste toner collection part connected to a waste toner collection container provided in the apparatus main body 3 (they are not shown). An opening (not shown) is formed in the enclosure part 53C along the front-and-rear direction. The magnet roller 51 is exposed through the opening.

Figure 3:
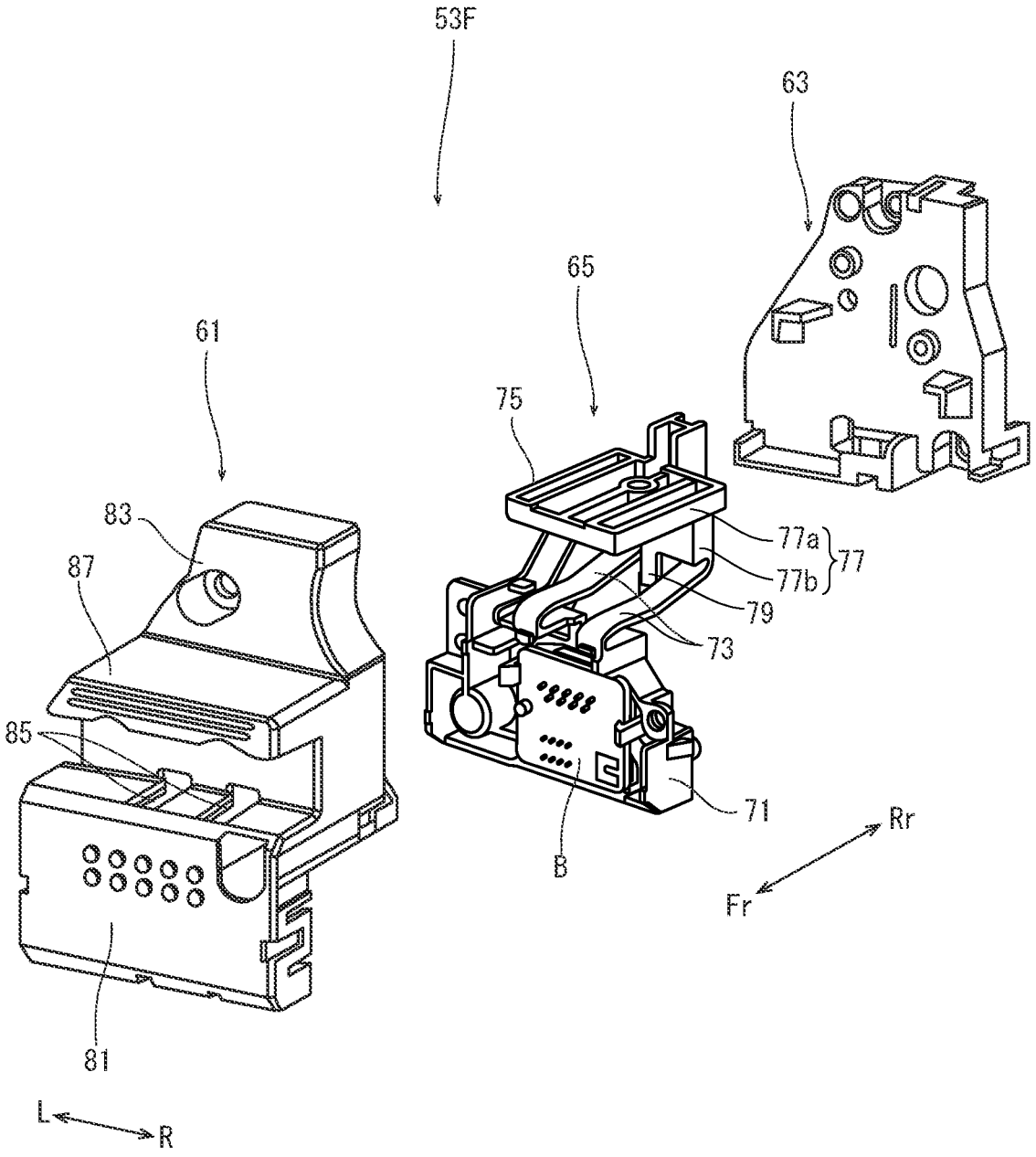
FIG. 3 is a disassembled perspective view showing a front end portion of the development device according to the embodiment of the present disclosure.
Figure 4:
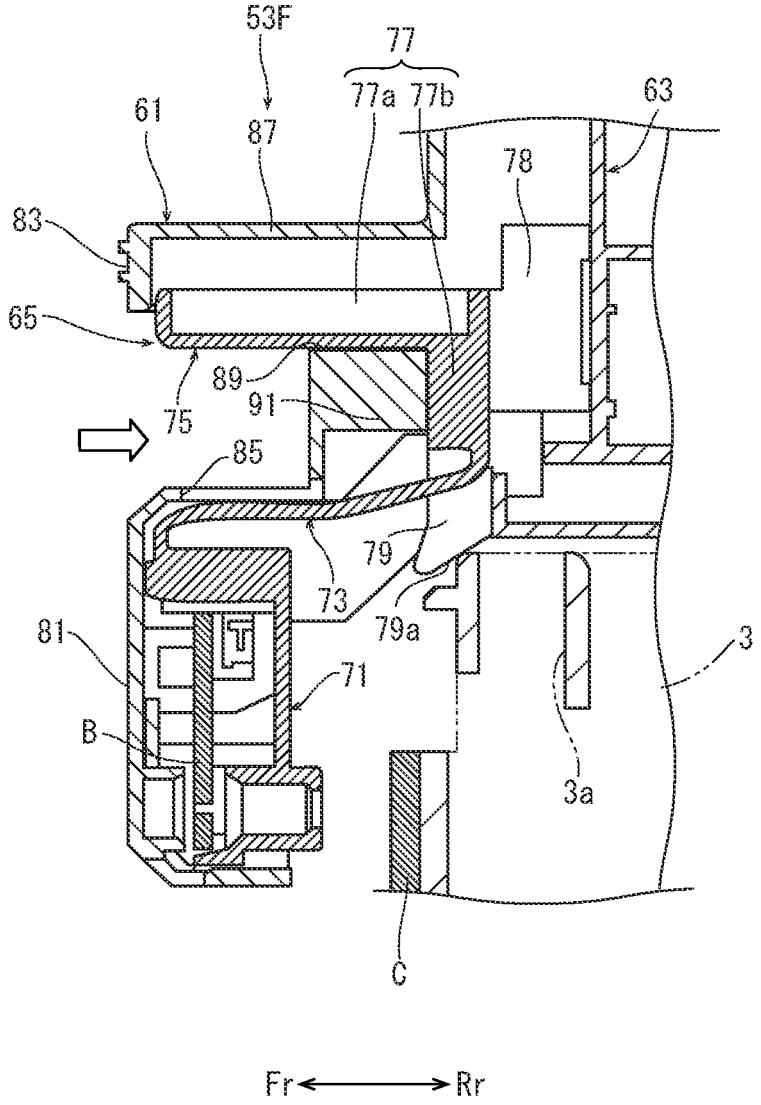
FIG. 4 is a sectional view showing the front end portion of the development device (in the middle of attachment to an apparatus main body) according to the embodiment of the present disclosure.
Figure 5:
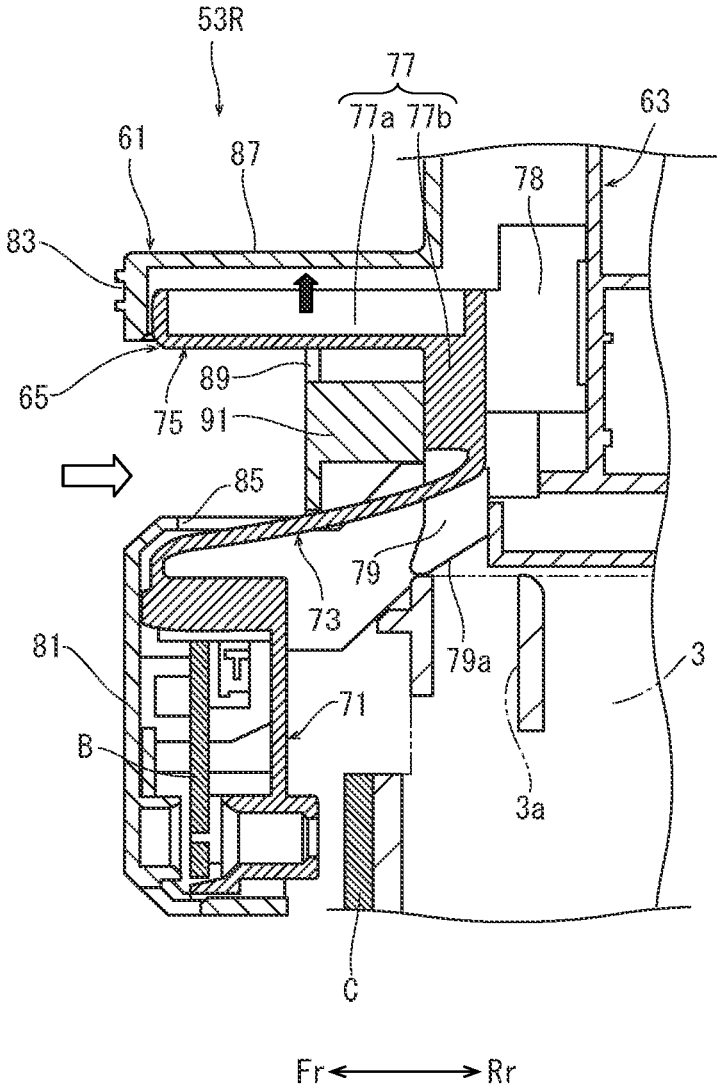
FIG. 5 is a sectional view showing the front end portion of the development device (in the middle of attachment to the apparatus main body) according to the embodiment of the present disclosure.
Figure 6:
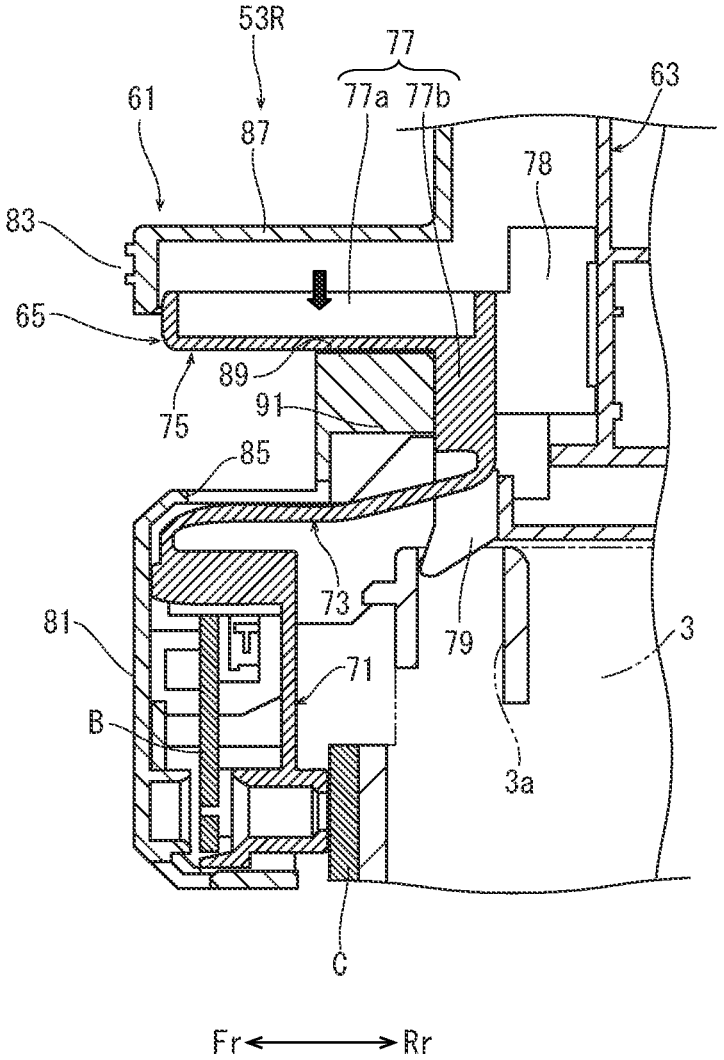
FIG. 6 is a sectional view showing the front end portion of the development device (after the attachment to the apparatus main body) according to the embodiment of the present disclosure.

Next, the front end part 53F of the housing 53 will be described with reference to FIG. 2 and FIG. 3 to FIG. 6. FIG. 3 is a disassembled perspective view showing the front end part 53F of the housing 53 of the development device 39, FIG. 4 and FIG. 5 are sectional views showing the front end part 53F of the housing 53 of the development device 39 in the middle of attachment to the apparatus main body 3, and FIG. 6 is a sectional view showing the front end part 53F of the housing 53 of the development device 39 attached to the apparatus main body 3.

As shown in FIG. 3, the front end part 53F of the housing 53 includes an outer cover plate 61 and an inner cover plate 63 which are an example of a cover part, and a holder member 65 supported between both the cover plates 61 and 63. The holder member 65 has a holder portion 71 by which a relay board B of each sensor is supported, and a lever portion 75 connected to the holder portion 71 by a pair of elastic arm portions 73, and is made of resin.

The holder portion 71 is formed in a rectangular plate-like shape when viewed from the inserting/drawing direction (the front-and-rear direction). The holder portion 71 has a mounting surface along a surface orthogonal to the inserting/drawing direction (a vertical surface). The relay board B is supported on the mounting surface with a vertical posture. The terminal pins (not shown) of the relay board B project rearward from the holder portion 71.

The lever portion 75 has a main body 77 and a hook 79. The main body 77 is formed in an L-shape when viewed from the left-and-right direction, and has a horizontal portion 77*a* and a vertical portion 77*b*. The horizontal portion 77*a* has a rectangular box-like shape when viewed from the upper-and-lower direction, whose upper surface is opened, and has a predetermined thickness along the upper-and-lower direction. In the open space of the horizontal portion 77*a*, a plurality of ribs is formed along the front-and-rear direction. The vertical portion 77*b* is formed so as to extend downward from the rear end portion of the horizontal portion 77*a*, has a rectangular box-like shape when viewed from the inserting/drawing direction (the front-and-rear direction), whose rear surface is opened, and has a predetermined thickness in the front-and-rear direction. In the open space of the vertical portion 77*b*, a plurality of ribs 78 (see FIG. 4 to FIG. 6) is formed along the upper-and-lower direction. The rear end surfaces of the ribs 78 are formed along the upper-and-lower direction. The hook 79 has a rectangular parallelepiped shape long in the upper-and-lower direction, and extends downward from the center portion of the lower surface of the vertical portion 77*b*. As shown in FIG. 4, the lower end surface 79*a* of the hook 79 is inclined obliquely upward from the front side toward the rear side.

The lower ends of the elastic arm portions 73 are connected to the upper end portion of the holder portion 71, and the upper ends of the elastic arm portions 73 are connected to the vertical portion 77*b* of the main body 77 of the lever portion 75 on both sides of the hook 79. The elastic arm portions 73 are inclined obliquely upward and backward from the lower end toward the upper end. When the elastic arm portions 73 are elastically deformed, the lever portion 75 is movable in the upper-and-lower direction with respect to the holder portion 71. At this time, the hook 79 moves in the upper-and-lower direction behind the holder portion 71.

The outer cover plate 61 and the inner cover plate 63 are disposed on the front side and the rear side of the holder member 65, and are connected to each other.

The outer cover plate 61 has a lower portion 81 in which the holder portion 71 of the holder member 65 is stored and an upper portion 83 in which the lever portion 75 of the holder member 65 is stored.

The lower portion 81 has a rectangular box-like shape when viewed in the inserting/drawing direction (the front-and-rear direction), whose rear surface is opened, and has a rectangular front wall, an upper wall, a lower wall, a left wall and a right wall which are provided around the outer periphery of the front wall. The upper wall is formed longer rearward than the other walls. In the upper wall, two grooves 85 (see FIG. 4) along the front-and-rear direction are formed with a predetermined interval.

The upper portion 83 has a substantially pentagonal box-like shape when viewed from the inserting/drawing direction (the front-and-rear direction), whose rear surface and lower surface are opened, and has a substantially pentagonal front wall, an upper wall, a left wall and a right wall which are provided around the outer periphery of the front wall. The front wall has a protruding portion 87 horizontally protruding forward. The protruding portion 87 has a rectangular box-like shape when viewed in the upper-and-lower direction, whose lower surface is opened, and has a rectangular upper wall and a peripheral wall around the outer periphery of the upper wall. As shown in FIG. 4, an opening 89 is formed in the front wall below the protruding portion 87. The opening 89 is communicated with a space surrounded by the upper wall and the peripheral wall of the protruding portion 87. On the rear surface of the front wall, a plurality of ribs 91 (see FIG. 4 to FIG. 6) protruding rearward is formed. The rear end surfaces of the ribs 91 are formed along the upper-and-lower direction.

The upper portion 83 is integrally formed with the rear end portion of the upper wall of the lower portion 81. A space is formed between the protruding portion 87 of the upper portion 83 and the lower portion 81 in the upper-and-lower direction.

The inner cover plate 63 has a substantially pentagonal box-like shape when viewed in the inserting/drawing direction (the front-and-rear direction), whose rear surface is opened, and has a substantially pentagonal front wall, which is the same shape as the upper portion 83 of the outer cover plate 61, and an outer peripheral wall around the outer periphery of the front wall. On the rear surface of the front wall, bearing portions to which the front end portions of the rotating shafts of the rollers are supported in a rotatable manner are formed.

The inner cover plate 63 is connected to the upper portion 83 of the outer cover plate 61 in a posture in which the rib 91 of the outer cover plate 61 and the front wall of the inner cover plate 63 are parallel to each other. The holder portion 71 of the holder member 65 is stored in the lower portion 81 of the outer cover plate 61 in an unmovable manner. At this time, the terminal pins of the relay board B supported by the holder portion 71 project rearward from the lower portion 81.

The lever portion 75 of the holder member 65 is supported between the upper portion 83 of the outer cover plate 61 and the inner cover plate 63. The horizontal portion 77*a* of the main body 77 is stored in the protruding portion 87 of the outer cover plate 61 through the opening 89 of the front wall of the upper portion 83. As shown in FIG. 4, the horizontal portion 77*a* protrudes downward from the space of the protruding portion 87 and is locked to the upper edge of the front wall of the upper portion 83. A predetermined space is formed between the horizontal portion 77*a* and the protruding portion 87 in the upper-and-lower direction. The vertical portion 77*b* (including the ribs 78) of the main body 77 is supported between the ribs 91 of the outer cover plate 61 and the front wall of the inner cover plate 63. The elastic arm portions 73 are stored in the two grooves 85 formed in the upper wall of the lower portion 81 of the outer cover plate 61.

An attachment operation of the development device 39 having the above configuration to the apparatus main body 3 will be described with reference to FIG. 4 to FIG. 6. The apparatus main body 3 is provided with a rear attachment part and a front attachment part to which the rear end part 53R and the front end part 53F of the housing 53 of the development device 39 are attached. The rear attachment part is provided with the driving source for each roller, and a replenishment port for the toner container 25 and a communication port for the waste toner collection container (they are not shown). As shown in FIG. 4, the front attachment part includes a recess 3*a* having an open upper surface, and a connector C disposed in front of the recess in a vertical posture. The connector C is connected to a controller (not shown) of the apparatus main body 3.

As shown in FIG. 4, when the development device 39 is inserted rearward (the inserting direction) to the apparatus main body 3 (see the hollow arrow in FIG. 4), the lower end surface 79*a* of the hook 79 of the lever portion 75 of the holder member 65 comes into contact with (interferes with) the front wall of the recess 3*a* of the apparatus main body 3 in front of the recess 3*a*.

As shown in FIG. 5, when the development device 39 is further inserted (see the hollow arrow in FIG. 5), the hook 79 is pushed up by the front wall of the recess 3*a*. Then, the hook 79, that is, the lever portion 75 of the holder member 65 moves upward relative to the holder portion 71 (see the black arrow in FIG. 5), and the pair of elastic arm portions 73 of the holder member 65 is elastically deformed. At this time, the horizontal portion 77*a* of the main body 77 of the lever portion 75 is separated away from the front wall of the upper portion 83, and is shifted upward through the opening 89 into the space of the protruding portion 87 of the outer cover plate 61. Further, the vertical portion 77*b* of the main body 77 of the lever portion 75 is shifted upward between the ribs 91 of the outer cover plate 61 and the front wall of the inner cover plate 63.

As shown in FIG. 6, when the development device 39 is further inserted and the hook 79 reaches the recess 3*a*, the hook 79 is engaged with the recess 3*a* to shift the lever portion 75 of the holder member 65 downward (see the black arrow in FIG. 6), and the elastic deformation of the pair of elastic arm portions 73 is released. As described above, the hook 79 is engaged with the recess 3*a* in a snap-fit manner. Thus, the development device 39 is prevented from coming off the apparatus main body 3. Further, the terminal pins of the relay board B are connected to the connector C of the front attachment part of the apparatus main body 3.

In the rear attachment part, the roller driving part is connected to the driving source, the toner replenishing part is communicated with the replenishing port of the toner container 25, and the waste toner collection portion is communicated with the communication port of the waste toner collection container. Further, the magnet roller 51 exposed from the opening of the enclosure part 53C faces the photosensitive drum 35.

When the development device 39 is detached from the apparatus main body 3, the horizontal portion 77*a* of the main body 77 of the holder member 65 and the protruding portion 87 of the outer cover plate 61 are held by fingers from the upper side and the lower side. Then, the horizontal portion 77*a* of the main body 77 of the holder member 65 is pushed up toward the protruding portion 87, the pair of elastic arm portions 73 is elastically deformed, and the lever portion 75 of the holder member 65 moves upward relative to the holder portion 71. At this time, the horizontal portion 77*a* of the main body 77 of the lever portion 75 moves upward in the space of the protruding portion 87 of the outer cover plate 61, and the vertical portion 77*b* moves upward between the ribs 91 of the outer cover plate 61 and the front wall of the inner cover plate 63. As a result, the hook 79 is separated upward from the recess 3*a* (see FIG. 5). Thereafter, the development device 39 is drawn out forward while keeping the holding of the horizontal portion 77*a* of the main body 77 of the holder member 65 and the protruding portion 87 of the outer cover plate 61 with the fingers, that is, while the lever portion 75 moved upward relative to the holder portion 71.

As described above, according to the present disclosure, since the hook 79 is engaged with the recess 3*a* in a snap-fit manner by the pair of elastic arm portions 73, the holder member 65 can be formed by one component. Thus, the assembly of the development device 39 can be made simple.

Further, because the lever portion 75 (the vertical portion 77*b* of the main body 77) of the holder member 65 is guided by both cover plates 61 and 63 (the ribs 91 of the outer cover plate 61 and the front wall of the inner cover plate 63) in the upper-and-lower direction, the hook 79 can be stably engaged with the recess 3*a* in a snap-fit manner.

Figure 7:
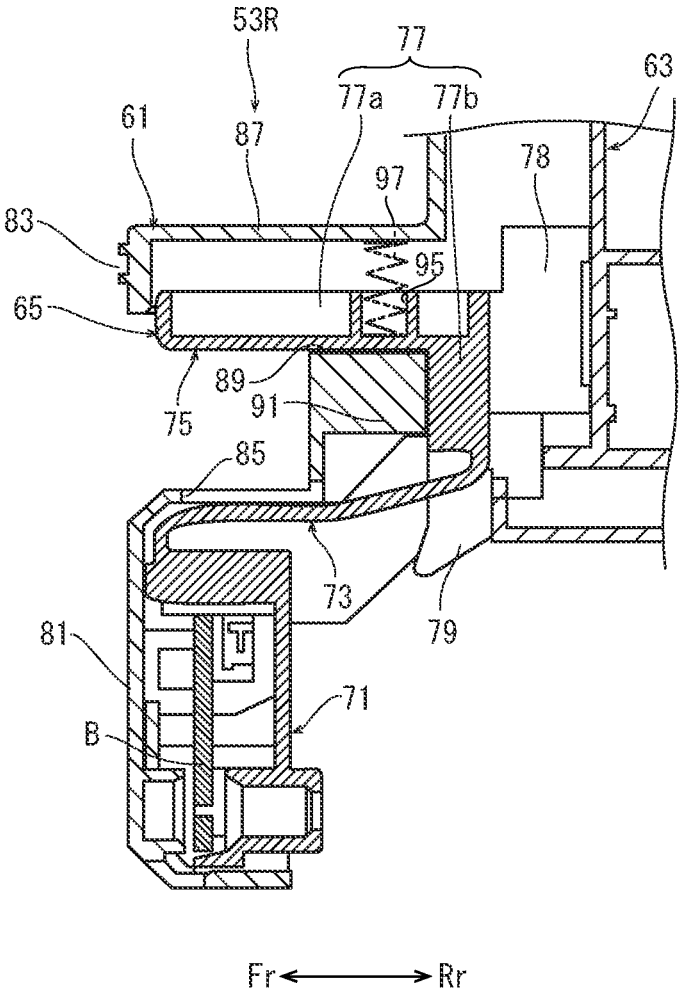
FIG. 7 is a sectional view showing the front end portion of the development device in a modified example of the development device according to the embodiment of the present disclosure.

Next, with reference to FIG. 7, a modified example of the development device 39 will be described. FIG. 7 is a sectional view showing the front end part 53F of the housing 53 of the development device 39. In the housing 53 of the modified example, the horizontal portion 77*a* of the main body 77 of the lever portion 75 of the holder member 65 is provided with a recess 95 extending in the upper-and-lower direction, whose upper surface is opened. In the recess 95, a coil spring 97 as an example of an elastic member can be housed.

Since the pair of elastic arm portions 73 of the holder member 65 is elastically deformed when the development device 39 is attached and detached, if the attachment and detachment operation is repeated, the pair of elastic arm portions 73 may be damaged. In this case, the coil spring 97 is housed in the recess 95. The coil spring 97 is disposed between the bottom surface of the recess 95 and the bottom surface of the space of the protruding portion 87 of the outer cover plate 61. If the pair of elastic arm portions 73 are broken, and the holder portion 71 and the lever portion 75 of the holder member 65 are separated from each other, the lever portion 75 is allowed to be moved in the upper-and-lower direction with respect to the holder portion 71 by elastic deformation of the coil spring 97.

That is, at the attachment of the development device 39, when the hook 79 of the lever portion 75 is pushed up by the front wall of the recess 3*a* of the apparatus main body 3 as described above, the coil spring 97 is compressed and the lever portion 75 moves upward relative to the holder portion 71. When the hook 79 reaches the recess 3*a*, the lever portion 75 is biased downward by the coil spring 97 so that the hook 79 is engaged with the recess 3*a*. At the detachment of the development device 39, when the horizontal portion 77*a* of the main body 77 of the holder member 65 and the protruding portion 87 of the outer cover plate 61 are held with the fingers from the upper side and the lower side, the lever portion 75 of the holder member 65 moves upward relative to the holder portion 71 against the biasing force of the coil spring 97, and the hook 79 is separated upward from the recess 3*a*. Thereafter, the development device 39 is drawn out forward while the lever portion 75 moved upward with respect to the holder part 71.

As described above, even when the pair of elastic arm portions 73 is damaged, the development device 39 can be repeatedly used by attaching the coil spring 97.

Although one aspect of the embodiment according to the present disclosure is described, the present disclosure is not limited to the above embodiment. The present disclosure may be modified, substituted, or modified in various ways without departing from the spirit of the technical idea.

The invention claimed is:

1. A development device attachable to and detachable from an apparatus main body in a predetermined inserting/drawing direction, the development device comprising:

a holder portion to which a board connectable to a controller of the apparatus main body is supported;

a hook which is engageable with a recess of the apparatus main body;

a lever portion in which the hook is provided; and at least one elastic arm portion which connects the holder portion and the lever portion, wherein in a middle of an attachment to the apparatus main body, the hook interferes with the apparatus main body to shift the lever portion in a direction crossing the inserting/drawing direction and to elastically deform the elastic arm portion, and when the hook is engaged with the recess, the elastic deformation of the elastic arm portion is released and the board is connected to the controller.

2. The development device according to claim 1, comprising a cover part which guides the lever portion along the direction crossing the inserting/drawing direction when the elastic arm portion is elastically deformed.

3. The development device according to claim 2, wherein, the cover part includes an outer cover plate and an inner cover plate which are disposed at a predetermined interval, and the lever portion is guided between the outer cover plate and the inner cover plate along the direction crossing the inserting/drawing direction.

4. The development device according to claim 3, wherein, the outer cover plate has a lower portion in which the holder portion is stored and an upper portion in which the lever portion is stored, the upper portion has a hollow protruding portion protruding in the horizontal direction and having an open lower surface, wherein before the development device is attached to the apparatus main body, the lever portion is positioned below the protruding portion, in a middle of the attachment of the development device to the apparatus main body, when the hook interferes with the apparatus main body, the lever portion is shifted in the direction crossing the inserting/drawing direction to be stored in the protruding portion, after the development device is attached to the apparatus main body and the hook is engaged with the recess, the lever portion is positioned below the protruding portion, and when the lever portion is pushed up so as to be stored in the protruding portion, the hook is separated away from the recess.

5. The development device according to claim 1, wherein, the at least one elastic arm portion includes two elastic arm portions, and the hook is disposed between the two elastic arm portions.

6. The development device according to claim 1, wherein, the lever portion has a recess part capable of housing an elastic member which biases the lever portion in a direction opposite to the direction crossing the inserting/drawing direction.

7. An image forming apparatus comprising an image forming part which forms a toner image on a sheet by the development device according to claim 1.

* * * * *